United States Patent [19]

Mower

[11] Patent Number: 4,543,738

[45] Date of Patent: Oct. 1, 1985

[54] SKI BOOT FOR CONCENTRATING A SKIER'S WEIGHT ON A SKI EDGE

[76] Inventor: Morton M. Mower, Five Roland Brook Ct., Lutherville, Md. 21093

[21] Appl. No.: 363,649

[22] Filed: Mar. 30, 1982

[51] Int. Cl.[4] ..... A43B 5/04; A63C 9/00

[52] U.S. Cl. ..... 36/117; 280/611; 280/636

[58] Field of Search ..... 36/117, 118, 119, 120, 36/121, 132, 103, 104; 280/611, 607, 623, 636

[56] References Cited

U.S. PATENT DOCUMENTS

| | | | |
|---|---|---|---|
| 3,411,224 | 11/1968 | Wagner | 36/117 |
| 4,262,925 | 4/1981 | Plenk | 280/636 X |
| 4,309,834 | 1/1982 | Bente | 36/117 |

FOREIGN PATENT DOCUMENTS

| | | | |
|---|---|---|---|
| 2449514 | 4/1976 | Fed. Rep. of Germany | 36/132 |
| 2803552 | 8/1979 | Fed. Rep. of Germany | 36/117 |
| 77123 | 10/1917 | Switzerland | 280/611 |

*Primary Examiner*—James Kee Chi

*Attorney, Agent, or Firm*—Fleit, Jacobson, Cohn & Price

[57] ABSTRACT

A ski boot for more easily concentrating the weight of a skier over the inside edge of a ski. A ski boot is provided with a sole having toe and heel pieces protruding therefrom, but offset in a direction toward the outside edge of the boot. The protruding portions are engageable by a conventional ski binding so that the weight of the skier is more concentrated over the inside edge (the edge closest to the inside of a skier's foot) of the ski.

11 Claims, 2 Drawing Figures

SKI BOOT FOR CONCENTRATING A SKIER'S WEIGHT ON A SKI EDGE

BACKGROUND OF THE INVENTION

1. Field of the Invention

The present invention relates to skiing. More particularly, the invention relates to a ski boot designed to be held by the associated binding in such manner that the centerline of the upper of the ski boot is offset inwardly from the longitudinal centerline of the ski so that the weight of the skier is more easily applied to the inner longitudinal edge of the ski during a turning movement.

2. Description of the Prior Art

It is well known that certain techniques of downhill skiing require a skier to preferentially weight the inner longitudinal edge of the ski to facilitate turning movements. The outer edge is understood to be that edge of one ski that faces away from the other ski when the skis are being used by a skier. Such weighting of the inner edge during turning requires both skill and strength on the part of the skier.

While it is often desirable for the skier to concentrate weight on the inner edge of one ski and then the inner edge of the other during downhill skiing, there are other conditions under which it is desirable to evenly weight both skis, such as when skiing in deep powder.

In all known prior art applications of skiing, the ski boot is mounted centrally on the ski, and the ability and strength of the skier to appropriately shift weight is the moving force to accomplish the desired weighting and "edging" maneuvers.

SUMMARY OF THE INVENTION

An object of the present invention is to provide a ski boot that can be related to a conventional ski and a conventional binding in such a manner that the skier is able to perform effective edging maneuvers with less strength than heretofore has been possible.

A related object of the present invention to provide a ski boot that can be related to a ski in such manner that preferential weighting of the inside edge of the ski is facilitated, while uniform weighting of the ski, when desired, can be accomplished.

In the principal embodiment of the invention, the preferential weighting of the inside edge of the ski is obtained by providing a ski boot having a sole with an enlarged portion protruding from the side of the upper corresponding to the outside edge of the foot. The protruding portion of the sole is engaged by a conventional ski binding positioned substantially along the longitudinal centerline of the ski. The centerline of the heel and toe portions is positioned substantially along the longitudinal centerline of the ski. The longitudinal centerline of the upper of the ski boot is spaced inwardly from the ski centerline so that the weight of the skier more easily is concentrated on the inside longitudinal edge of the ski.

In another embodiment of the invention, the sole of the ski boot is of standard width, but is offset outwardly relative to the centerline of the upper. Again, the effect is to facilitate weighting on the inside edge of the ski during turning maneuvers.

The invention, and its objects and advantages, will become more apparent in the detailed description of a preferred embodiment hereinafter presented.

BRIEF DESCRIPTION OF THE DRAWINGS

In the detailed description of the preferred embodiment of the invention hereinafter presented, reference is made to the accompanying drawings, in which.

DESCRIPTION OF THE PREFERRED EMBODIMENT

The present description will be directed in particular to elements forming part of, or cooperating more directly with, the present invention. Elements not specifically shown or described herein are understood to be selectable from those known in the art.

Figure 1:
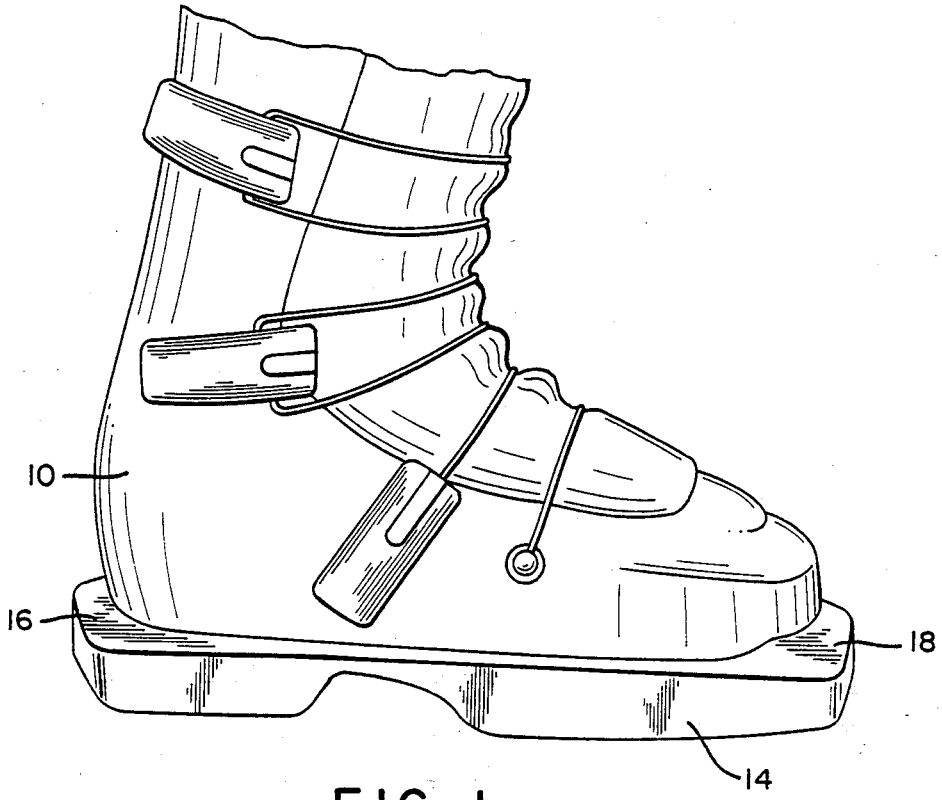
FIG. 1 is a perspective view of a ski boot according to the present invention.

Referring now to the drawings, and to FIG. 1 in particular, one embodiment of the present invention is illustrated and will be described in connection with a ski boot, generally designated 10. The ski boot 10 (shown as a right boot) has a conventional upper 12 connected to a sole 14. The sole 14 extends underneath part or all of the upper, and includes a heelpiece 16 and a toepiece 18 protruding from the heel and toe regions of the upper for engagement with a conventional ski binding, such as the binding 20 schematically illustrated in FIG. 2.

As illustrated in the drawings, the sole 14 is of a width greater than that of the upper. This embodiment contemplates that the heelpiece 16 and the toepiece 18 be of reduced width, as seen best in FIG. 2 so as to conform to standard bindings. In the embodiment of the invention where the width of the offset sole is substantially the width of the upper, the heelpiece and the toepiece need not be of reduced width.

Figure 2:
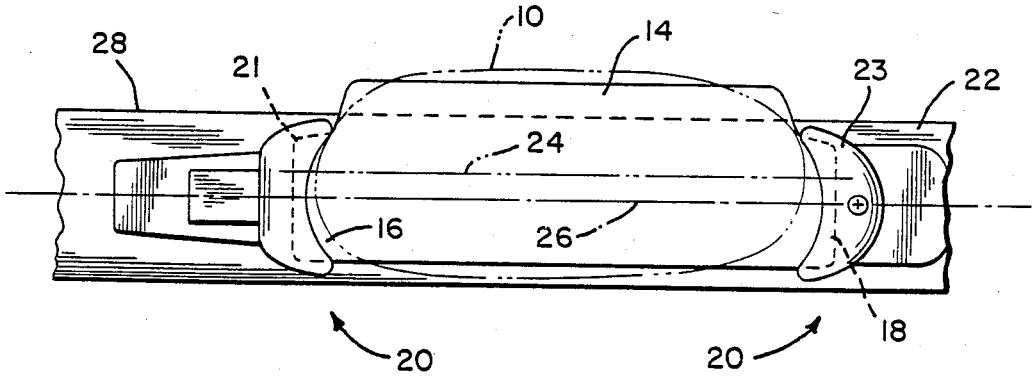
FIG. 2 is a schematic top view illustrating the ski boot of FIG. 1 clamped to a ski.

Referring specifically to FIG. 2, the ski boot 10 is illustrated (in phantom) in a position releasably clamped by the bindings 20 to the upper surface of a ski 22. Bindings 20 comprise a heel binding 21 and a toe binding 23 of conventional size and shape. The centerline 24 of the upper is offset inwardly from the longitudinal centerline 26 of the ski so that the weight of the skier is more easily concentrated on or over the inner longitudinal edge 28 of the ski.

As a result, less strength is required in order to concentrate the weight of the skier on the inner edge of the ski during a turning or other skiing movement.

Although the offset improves the ability to set an edge, the amount of offset between the centerline of the upper and the centerline of the ski is designed such that it still is a relatively easy matter to evenly distribute the weight of the skier on both skis. Such even distribution would be desirable, for instance, when skiing in deep powder.

By way of a specific example, using conventional skis on the order of 4 cm in width, it is contemplated that the centerline of the boot upper be offset inwardly by on the order of 1–15 mm, preferably about 4–5 mm. This, essentially, moves inwardly the centerline of the boot upper by approximately $\frac{1}{4}$ the distance between the centerline and the inside edge of the ski.

Previously, specific embodiments of the present invention have been described. It should be appreciated, however, that such embodiments have been described for the purposes of illustration only, without any intention of limiting the scope of the present invention. Rather, it is the intention that the present invention be limited only by the appended claims.

What is claimed is:

1. A ski boot for use in combination with a ski, said boot having an upper and a sole connected to the upper, said sole including a heelpiece and a toepiece protruding from and integral with the sole and adapted to be engaged by a binding, said heelpiece and said toepiece being offset to the outside of the boot so that the ski boot is clampable to the ski in a position in which the longitudinal centerline of the upper is offset inwardly from the longitudinal centerline of the ski, thereby allowing the weight of a skier more easily to be concentrated over the inside longitudinal edge of the ski.

2. The boot of claim 1, wherein the longitudinal centerline of the upper is offset by a distance of approximately ¼ the distance between the inside longitudinal edge and the centerline of the ski.

3. The boot of claim 1, wherein the heelpiece and toepiece are offset outwardly from the centerline of the upper by an offset distance of between 1 and 15 mm.

4. The boot of claim 3, wherein said offset distance is on the order of 4–5 mm.

5. A ski boot for use in combination with a ski and a ski binding mounted on the centerline of the ski for releasably securing a ski boot to the ski, said ski boot having an upper and a sole releasably securable to the ski said sole being adapted such that the ski boot is releasably securable to the ski in a position in which the centerline of the upper is offset inwardly from the longitudinal centerline of the ski so that the weight of the skier can more easily be biased toward the inside longitudinal edge of the ski, the inside edge being the edge closest to the inside edge of the foot of a skier received in the ski boot.

6. A ski boot having a sole, an upper connected to the sole, and protruding heel and toe pieces integral with the sole for engaging a ski binding connected to a ski, said heel and toe pieces being offset outwardly from the longitudinal centerline of the upper, the ski boot thus being clampable to the ski in a position in which the centerline of the upper is offset from the centerline of the ski towards the inside edge of the ski, so that the weight of the skier can more easily be concentrated on the inside longitudinal edge of the ski.

7. A ski boot for use in combination with a ski, said ski boot comprising an upper for receiving the foot of a skier; a sole supporting said upper; protruding heel and toe portions extending from the sole at the heel and toe of the boot for engagement with the bindings of a ski; said heel and toe portions being positioned so that the centerline of the heel and toe portions is positioned substantially along the longitudinal centerline of the ski and is offset outwardly from the centerline of the upper.

8. The ski boot of claim 7, wherein said offset is between 1 and 15 mm.

9. The ski boot of claim 7, wherein said offset is on the order of 4–5 mm.

10. The ski boot of claim 7, wherein said sole, said heel portion and said toe portion are all of the same width.

11. The ski boot of claim 7, wherein said sole underlies substantially the entire upper, and extends from the upper on the outside of the boot; and wherein the width of the heel and toe portions is smaller than the width of the sole underlying and extruding from the upper.

* * * * *